US007584014B2

(12) United States Patent
Gotti et al.

(10) Patent No.: US 7,584,014 B2
(45) Date of Patent: Sep. 1, 2009

(54) CONTROL UNIT FOR YARN-BRAKING DEVICES IN WEFT FEEDERS FOR LOOMS, AND TUNING METHOD THEREFOR

(75) Inventors: Andrea Gotti, Albino (IT); Luca Gotti, Albino (IT)

(73) Assignee: L.G.L. Electronics S.p.A., Gandino (IT)

( * ) Notice: Subject to any disclaimer, the term of this patent is extended or adjusted under 35 U.S.C. 154(b) by 388 days.

(21) Appl. No.: 11/455,830

(22) Filed: Jun. 20, 2006

(65) Prior Publication Data

US 2007/0028989 A1 Feb. 8, 2007

(30) Foreign Application Priority Data

Jul. 14, 2005 (IT) ..... TO2005A0484

(51) Int. Cl.
*G06F 19/00* (2006.01)

(52) U.S. Cl. ..... 700/140; 242/365.4; 139/194; 139/256 R; 139/450

(58) Field of Classification Search ..... 700/140, 700/143; 139/194, 212, 256 R, 450, 452; 242/365.4
See application file for complete search history.

(56) References Cited

U.S. PATENT DOCUMENTS 5,425,399 A * 6/1995 Shindo et al. ..... 139/450
6,095,449 A * 8/2000 Gallo et al. ..... 242/365.4
6,269,844 B1 * 8/2001 Zenoni et al. ..... 139/452
6,328,081 B1 * 12/2001 Gotti et al. ..... 139/450
6,418,976 B2 * 7/2002 Loehr et al. ..... 139/450
6,752,177 B2 * 6/2004 Zenoni et al. ..... 139/452
2005/0203659 A1 * 9/2005 Siegl ..... 700/143

FOREIGN PATENT DOCUMENTS

EP 1314806 A2 * 5/2003
EP 1405941 A1 * 4/2004

* cited by examiner

*Primary Examiner*—Gary L Welch
*Assistant Examiner*—Nathan E Durham
(74) *Attorney, Agent, or Firm*—Modiano & Associati; Albert Josif; Daniel J. O'Byrne

(57) ABSTRACT

A control unit for yarn-braking devices in weft feeders for looms, in which the yarn unwinding from the feeder is pressed between a drum and a braking member connected to two linear actuators controlled by position and provided with position sensors. A position control loop receives a position signal from the sensor and compares it with a reference variable in a subtracter for obtaining a position error. A position compensator receives the position error and outputs a reference current entering a current control loop connected to generate a voltage that supplies the actuator. The compensator incorporates a control transfer function that is variable as a function of an elastic constant of a mass-spring equivalent system, where the mass is the mass of the parts in motion between the braking member and the actuators, and the elastic constant matches with the elastic constant of the elastic elements.

2 Claims, 5 Drawing Sheets

CONTROL UNIT FOR YARN-BRAKING DEVICES IN WEFT FEEDERS FOR LOOMS, AND TUNING METHOD THEREFOR

The present invention relates to a control unit for yarn-braking devices in weft feeders for looms, in particular rapier looms, projectile looms and air-jet looms, and to a tuning method therefor.

BACKGROUND OF THE INVENTION

As it is known, weft feeders for textile machines comprise a stationary drum on which a plurality of yarn loops forming a weft reserve are wound. Upon request from the loom, the loops are unwound from the drum, then pass through a braking device which controls the tension of the yarn, and finally feed the loom.

In the weft feeders of the above kind, which are known from prior art documents in the name of the present Applicant, such as EP 1 059 375, the braking device typically comprises a frustoconical hollow member which is supported at the centre of an annular support on a spider assembly of springs, and is biased with its inner surface against the end of the drum from which the loops are unwound. A pair of linear actuators operatively connected to the annular support are driven by a control unit having a position control loop and a current control loop, which is capable of generating a modulated current as a function of the fluctuations of the yarn tension, in order to modulate the pressure applied upon the drum by the cone. This assembly is supported on a slide that is longitudinally movable under control of a worm screw mechanism that is manually operable in order to adjust the static pressure, or preload, applied upon the drum by the cone at rest. Therefore, the unwinding yarn runs between the drum and the frustoconical member, which modulately applies the desired braking action upon the yarn.

Although the above control unit allows the braking action to be modulated smoothly and dynamically, however it has the drawback that its accuracy considerably decreases when certain parameters are changed, such as the stiffness of the springs which support the frustoconical member, or the static pressure applied upon the drum by the cone, which parameters are chosen, e.g., on the basis of the type of yarn under processing, the loom speed, the loom height, and the like. In fact, as well known to the person skilled in the art, the position control loop is designed to operate accurately with a specific set of springs and with a predetermined value of preload. On the contrary, changing these parameters results in an error of compensation. The more said parameters differ from the design parameters, the more relevant said error.

SUMMARY OF THE INVENTION

Therefore, it is a main object of the present invention to provide a control unit for yarn-braking devices in weft feeders for looms, which can be tuned in an automatized way on the basis of variable parameters concerning the yarn-braking device, in particular, the stiffness of the springs and the static pressure, as well as to provide a setting or tuning method for the control unit, which can be easily automatized and requires a short execution time.

The above object and other advantages, which will better appear below, are achieved by a control unit having the features recited in claim 1, while the other claims state other advantageous, though secondary, features of the invention.

BRIEF DESCRIPTION OF THE DRAWINGS

The invention will be now described in more detail with reference to a few preferred, non-exclusive embodiments, shown by way of non limiting example in the attached drawings, wherein.

DESCRIPTION OF THE PREFERRED EMBODIMENTS

Figure 1:
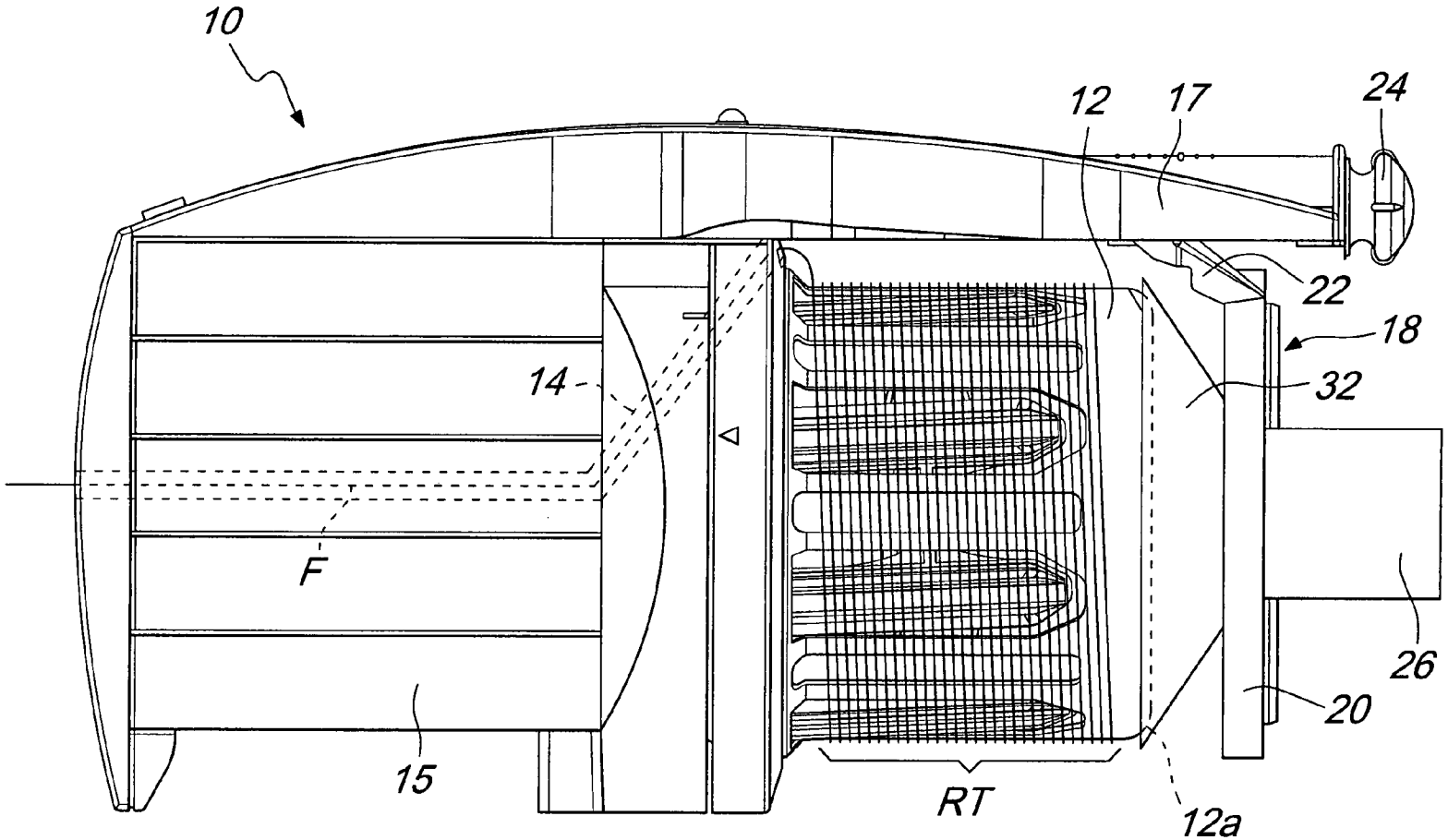
FIG. 1 is a view in side elevation of a general weft feeder provided with a yarn-braking device.

With reference to the above Figures, a weft feeder 10 for textile machines comprises a stationary drum 12 provided with a beveled delivery edge 12*a*, on which a swivel arm 14 driven by a motor 15 winds a plurality of yarn loops forming a weft reserve RT.

A stationary arm 17 parallel to the axis of the drum projects from the motor housing and supports a yarn-braking device 18 having the task of controlling the tension of the yarn unwinding from the drum.

Figure 2:
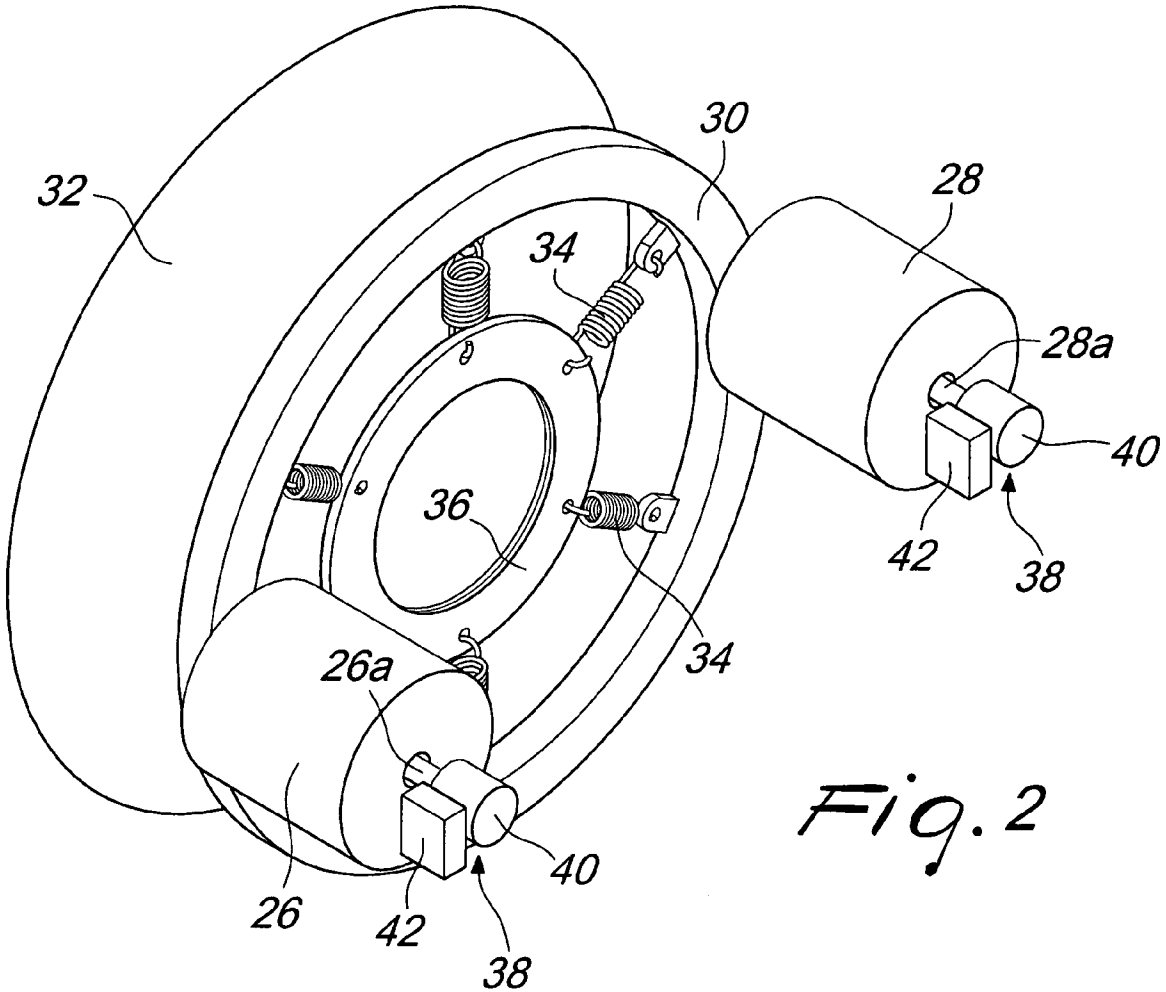
FIG. 2 is a perspective view which separately shows the yarn-braking device of FIG. 1.
Figure 3:
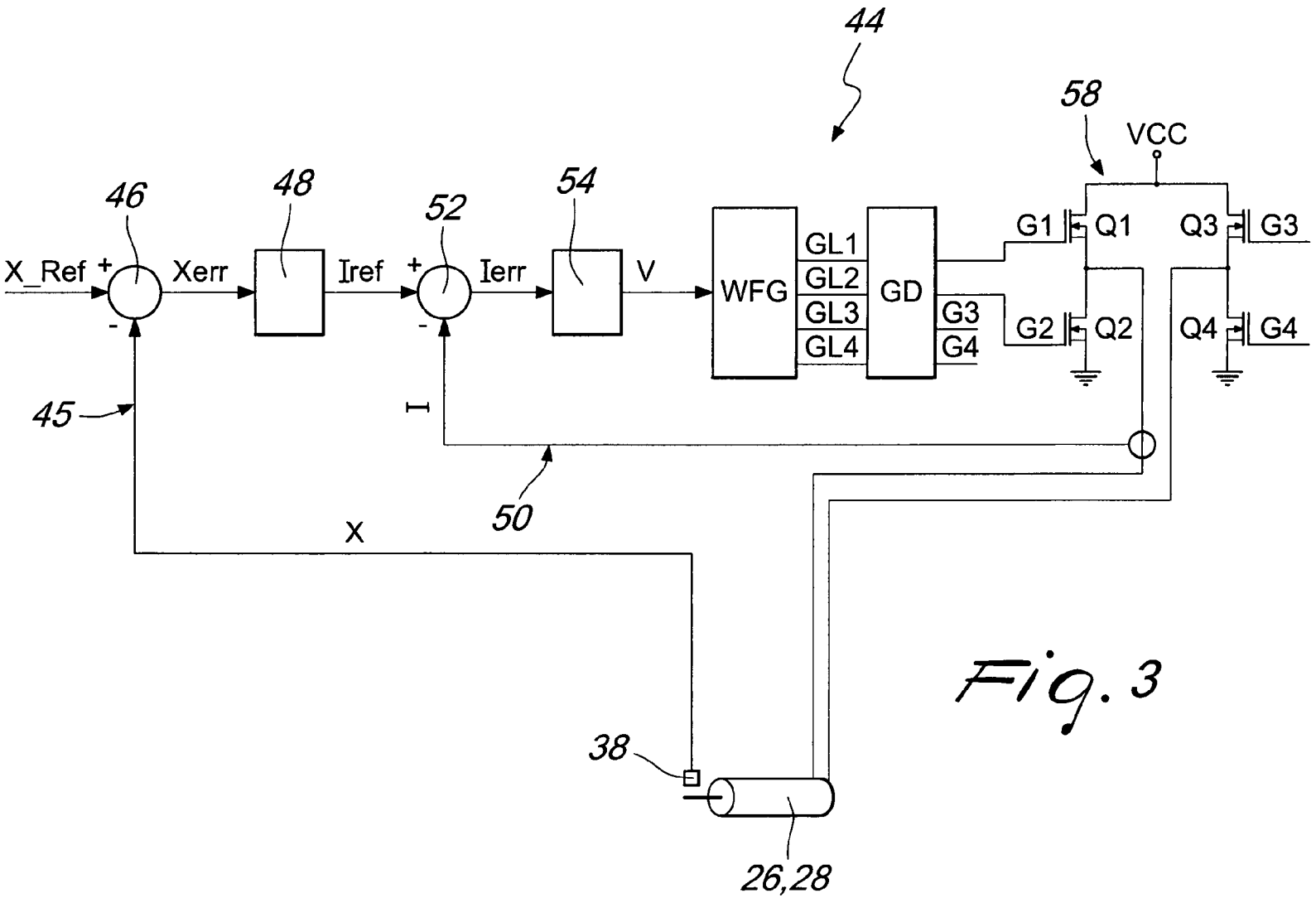
FIG. 3 is a block diagram of a position control loop according to this invention, which is suited to control the braking device of FIG. 2.

The yarn-braking device 18 comprises a frame 20 supported on a slide 22 that is movable along the stationary arm 17 under control of a worm screw mechanism (not shown) that is operable by a knob 24. In a known way, frame 20 supports a pair of electromechanical, linear actuators 26, 28 (FIG. 2) arranged with their respective driving rods 26*a*, 28*a* parallel to the axis of the drum at respective, diametrically opposed positions. An annular support 30 coaxial with the drum is supported at the free ends of the driving rods. A hollow, frustoconical braking member 32 is supported at the centre of annular support 30 by elastically yielding support means, which consist of a spider assembly of springs 34 each having one end anchored to the annular support and an opposite end anchored to a ring 36 integral with the smaller base of frustoconical member 32. The latter is arranged with its larger base coaxially facing the drum and is biased with its inner surface against beveled edge 12*a*. Actuators 26, 28 are equipped with respective position sensors 38, each of which comprises a magnet 40 attached to the driving rod of the respective actuator, as well as a Hall sensor 42 supported at a fixed position near the magnets and connected for sending position signals X to a control unit 44 (FIG. 3). One control unit is provided per each actuator. The control unit is capable of generating a modulated current as a function of the fluctuations of the yarn tension in order to modulate the pressure applied upon the drum by the cone.

Having now reference to FIG. 3, control unit 44 comprises a position control loop 45 which receives the position signal X from position sensor 38 and compares it with a reference variable X_ref in a first subtracter block 46, thereby obtaining a position error Xerr. A position compensator 48 processes the value Xerr and outputs a corresponding reference current Iref. An inner, current control loop 50 receives current signal Iref in a second subtracter block 52 and compares it with the current I across the actuator, thereby obtaining a current error Ierr. In a known way, current error Ierr is sent to a current compensator 54 that processes this signal to obtain a voltage value V. The latter supplies a wave form generator WFG which generates four low-level pilot signals GL1-GL4 which drive respective MOS field effect transistors Q1-Q4, usually called MOSFET (Metal Oxide Semiconductor Field Effect Transistor), which are arranged to form an H-bridge 58 which pilots a respective one of said actuators 26, 28. A gate driver GD is arranged between wave form generator WFG and bridge 58, in order to shift signals GL1-GL4 to voltage levels G1-G4 compatible with the gate of MOSFETs Q1-Q4 of bridge 58.

The braking assembly according to this invention is representable by means of an equivalent mass-spring system, with an equivalent mass corresponding to the mass of the parts in motion, i.e., rods 26*a*, 28*a*, magnets 40, annular support 30 and springs 34, and an elastic constant k which takes into account both the stiffness of the springs forming the spider assembly, and the elastic yielding of the frustoconical member. Position compensator 48 also includes a transfer function which changes as a function of elastic constant k, and is connected for receiving variable values of said elastic constant k which are calculated by executing a preliminary tuning procedure in control unit 44.

Figure 4:
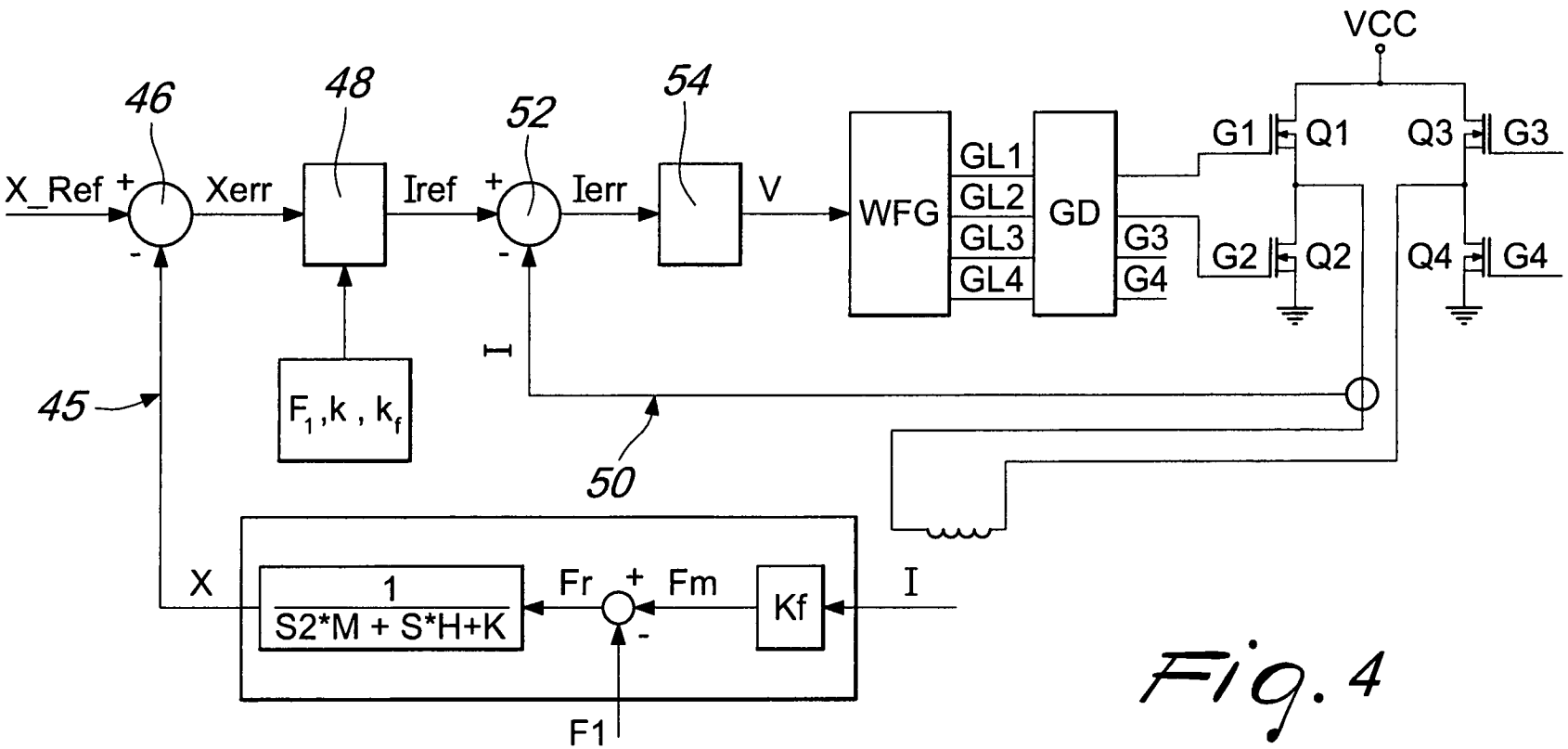
FIG. 4 shows the block diagram of FIG. 3 during the execution of a tuning method according to the invention.

As shown in FIG. 4, which illustrates the block diagram of FIG. 3 during the execution of a tuning procedure according to this invention, the driving force Fm exerted by the actuator is calculated by multiplying the current i across the actuator by a force constant Kf, which usually is assigned to the actuator, but can also be calculated, as will be better described below. The preload force F1 of the springs, which is measured with the rod in its innermost stop position (resting position), is subtracted from the driving force Fm, thereby obtaining resulting force Fr that is applied to a transfer function of the type:

$$\frac{1}{s^2 \cdot m + s \cdot h + k},$$

where m is the mass of the parts in motion, h is the viscous friction coefficient of the system, k is the elastic constant, and s is the complex pulsation, in order to obtain a corresponding displacement X.

In a first embodiment of the invention, the tuning method comprises the steps of: a) positioning the rod of the actuator at a first measuring position between the opposed stop positions X1-X2, preferably a measuring position X3 corresponding to a half of the rod stroke, with the actuator controlled by means of an accessory, slow position control loop with a narrow passband, e.g., a passband of 1 Hz, b) overlaying a broad-band, variable current signal, preferably a periodical, symmetrical current signal (e.g., a rectangular signal), to the current i3 required for maintaining the rod at the measuring position X3, whereby the load is excited above its mechanical resonance frequency, c) calculating the coefficients a0, a1, a2 of the numerical transfer function $$\frac{1}{a0 + a1/z + a2/z^2}$$

which connects the current across the actuator to the position of the rod, by means of calculation methods well known to the person skilled in the art, such as batch identification methods (e.g., minimum squares), or recursive methods (e.g., recursive minimum squares), d) calculating the static gain, i.e., with z=1, of the numerical transfer function that connects the current across the actuator to the position of the rod, i.e., $$f.d.t.(z = 1) = \frac{1}{a0 + a1 + a2}$$

e) calculating the resonance frequency $f_{ris}$ of the numerical transfer function by means of numerical methods well known to the person skilled in the art, such as Fourier transform methods, for example by discrete values, f) calculating the value of the elastic constant k of the equivalent system by inserting the value of the measured resonance frequency into the numerical transfer function, according to the formula s=j2□f, whereby, under conditions of low viscous friction (h=0), $$k=m*(2\pi f_{ris})^2,$$

g) calculating the value of the force constant kf by multiplying the transfer function in condition of direct current f.d.t.(z=1) by the calculated elastic constant k, i.e.:

$$kf=k/(a0+a1+a2)$$

h) compensating the position control loop of each actuator with the calculated parameters which relate thereto.

The above method allows both the equivalent elastic constant k and the force constant kf of the actuators to be determined.

In an alternative embodiment of the invention, in which the force constant kf of the actuators is assumed to be known, the tuning method comprises the steps of:

a) positioning the rod of the actuator at a first measuring position X1 very close to the innermost stop position in which the brake is at rest and the braking member applies the lowermost pressure upon the drum, b) measuring the current i1 required for maintaining the rod at the first measuring position X1, across each actuator, c) positioning the rod of the actuator at a second measuring position X2 very close to the outermost stop position in which the braking member applies the highermost pressure upon the drum, d) measuring the current i2 required for maintaining the rod at the second measuring position X2, across each actuator, e) calculating the forces F1, F2 exerted by the linear actuator at the measuring positions X1, X2 respectively, by multiplying the force constant kf of the actuators by the measured current values i1, i2 respectively, f) calculating the elastic constant of the equivalent system k by dividing the difference between the forces exerted by the linear actuator at the measuring positions X1, X2 by the difference between the measuring positions X1, X2, i.e.:

$$\frac{F2 - F1}{X2 - X1}$$

g) similarly to the previous embodiment, compensating the position control loop of each actuator with the calculated parameters which relate thereto.

Therefore, the above procedure allows both the equivalent elastic constant k and the preload force F1 to be calculated. The equivalent elastic constant is the angular coefficient of the line of FIG. 5, which line represents the force F as a function of the displacement X in the equivalent system (X0 is the position with the springs at rest).

Figure 5:
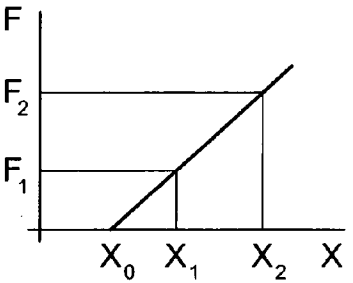
FIG. 5 is a force-position diagram concerning the control unit according to the invention.
Figure 6:
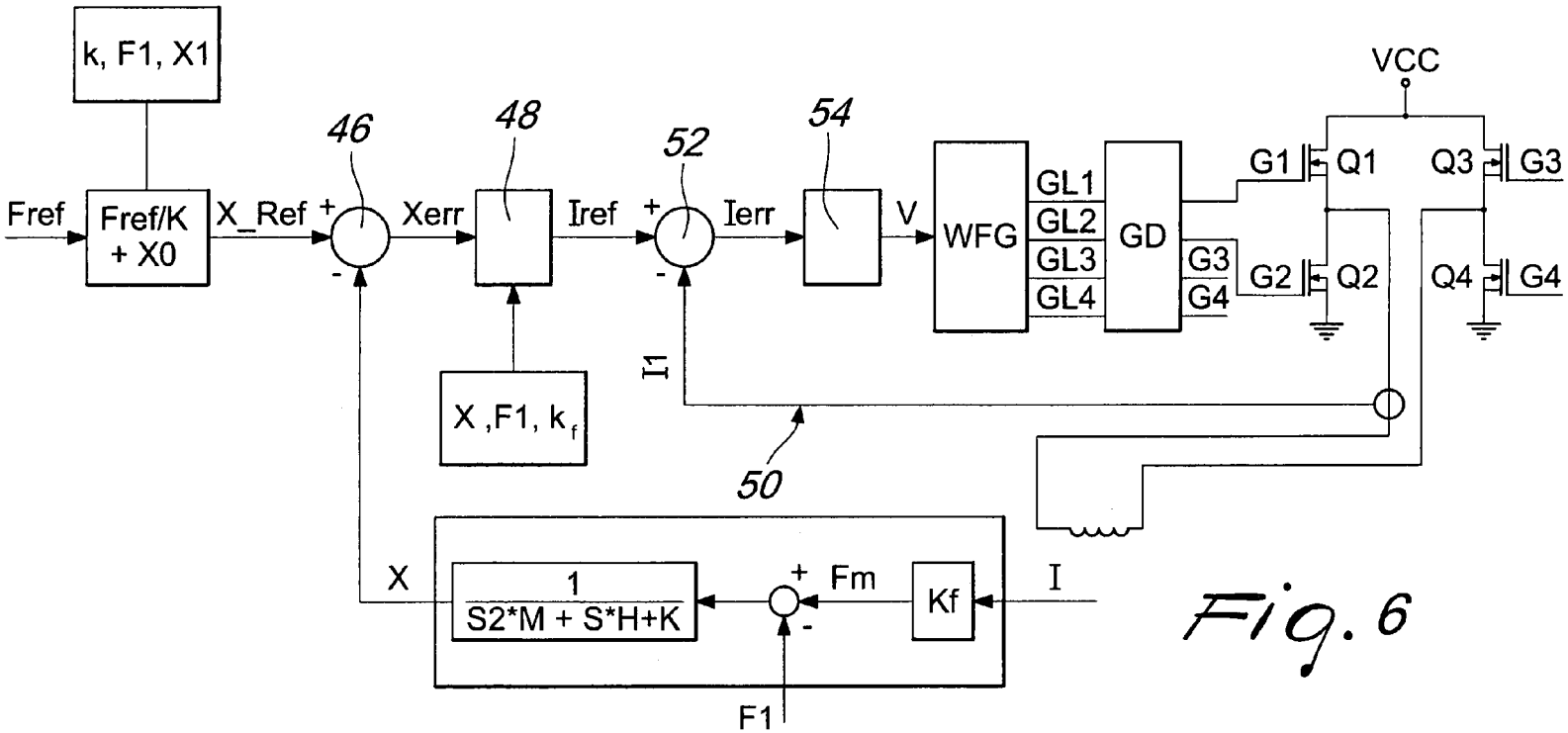
FIG. 6 shows the block diagram of FIG. 3 during the execution of a tuning method according to an alternative embodiment of the invention.

Advantageously, as shown in FIG. 6, the reference variable X_ref is calculated by using the braking force of the springs Fref as main reference value, according to the relation:

$$X_Ref = \frac{Fref - F1}{k} + X1$$

which relation derives from simple algebrical calculations deriving from the line of FIG. 5. This allows the differences between different actuators to be automatically compensated, so that the same desired braking action will be virtually obtained.

Of course, the above-described tuning methods are particularly suited to be automatized by means of computer-assisted processing techniques, which are intended to be known to the person skilled in the art, e.g., by incorporating their procedures in the feeder-starting routine so that, when the feeder is started, the control unit is automatically set to the parameters of stiffness and preload of the system. The measured values of elastic constant k, force constant kf, and preload F1, may also be visualized, e.g., on a monitor accessible to the operator, in a conventional way, in order to supply the operator with informations useful for manually tuning the system.

A few preferred embodiments of the invention have been described herein, but of course many changes may be made by the person skilled in the art within the scope of the appended claims.

The disclosures in Italian Patent Application No. T02005A000484 from which this application claims priority are incorporated herein by reference.

What is claimed is:

1. A control unit for yarn-braking devices in weft feeders for looms, in which a yarn unwinding from a feeder is pressed between a drum of the feeder and a braking member which is operatively connected—with interposition of elastically yelding support means—to at least one linear actuator controlled by position and equipped with a position sensor, said control unit comprising one position control loop per each actuator, which receives a position signal from the position sensor and compares the position signal with a reference variable in a first subtracter block for obtaining a position error, as well as a position compensator which receives the position error and outputs a corresponding reference current entering a current control loop connected to generate a modulated voltage that supplies the actuator, wherein said position compensator incorporates a control transfer function which is variable as a function of an elastic constant of a mass-spring equivalent system, where the mass is the mass of parts in motion interposed between said braking member and at least one linear actuator, and the elastic constant substantially matches with the elastic constant of said elastically yielding support means, and wherein said position compensator is connected for receiving variable values of said elastic constant which are calculated by executing a preliminary tuning procedure in the control unit.

2. The control unit of claim 1, wherein said reference variable is calculated by using a reference braking force as main reference value, according to the relation $$X_Ref = \frac{Fref - F1}{k} + X1$$

where X_ref is the reference variable, Fref is said reference braking force, X1 is a first stop position with the actuator at rest, k is the elastic constant, and F1 is the force exerted by the actuator near the first stop position X1.

* * * * *